US005385041A

United States Patent [19]

Andrews

[11] Patent Number: 5,385,041

[45] Date of Patent: Jan. 31, 1995

[54] PISTON ROD STABILIZING DEVICE FOR A RIVETING APPARATUS RAM ASSEMBLY

[75] Inventor: Mark J. Andrews, Niagara Falls, N.Y.

[73] Assignee: Gemcor Engineering Corporation, Buffalo, N.Y.

[21] Appl. No.: 928,807

[22] Filed: Aug. 12, 1992

[51] Int. Cl.[6] ..... B21J 15/16

[52] U.S. Cl. ..... 72/453.14; 72/453.19; 72/456; 29/243.54; 92/165 PR; 227/51

[58] Field of Search ..... 227/51, 53; 29/243.523, 29/243.53, 243.54, 525.2; 72/456, 453.14, 453.17, 453.19; 100/269 R; 92/165 R, 165 PR, 166

[56] References Cited

U.S. PATENT DOCUMENTS

| | | | |
|---|---|---|---|
| 664,229 | 12/1900 | Raymond | 227/51 |
| 3,966,849 | 12/1976 | Del Jiacco | 100/269 R X |
| 4,603,573 | 8/1986 | Ganago et al. | 72/456 X |
| 4,662,556 | 5/1987 | Gidlund | 227/69 |
| 4,669,365 | 6/1987 | Stoll | 92/165 PR |
| 4,682,535 | 7/1987 | Stoll | 92/165 PR |
| 4,696,180 | 9/1987 | Zandel | 72/456 |
| 4,736,675 | 4/1988 | Stoll | 92/165 PR |
| 4,854,491 | 8/1989 | Stoewer | 227/58 |
| 4,908,928 | 3/1990 | Mazurik et al. | 29/525.1 |
| 5,042,137 | 8/1991 | Speller, Sr. | 29/525.2 |
| 5,098,001 | 3/1992 | Smart et al. | 227/51 X |
| 5,199,624 | 4/1993 | Smart et al. | 227/51 X |
| 5,222,289 | 6/1993 | Michalewski et al. | 29/525.2 X |
| 5,265,423 | 11/1993 | Glaser | 92/165 PR X |
| 5,305,683 | 4/1994 | Gosdowski et al. | 92/165 R X |

FOREIGN PATENT DOCUMENTS

| | | | |
|---|---|---|---|
| 165244 | 1/1934 | Switzerland | 92/165 R |
| 224285 | 8/1968 | U.S.S.R. | 29/243.54 |

*Primary Examiner*—Rinaldi I. Rada
*Assistant Examiner*—Clark F. Dexter
*Attorney, Agent, or Firm*—Hodgson, Russ, Andrews, Woods & Goodyear

[57] ABSTRACT

A ram assembly for riveting apparatus. The piston rod is stabilized for close tolerance or minimum lateral deviation at the work point by linear bearings which ride on an elongate stabilizer bar and are mounted on an elongate member which is in turn rigidly attached to the piston rod for movement therewith, the lateral deviation of the piston rod being controlled by the orientation of the stabilizer bar. This allows a stabilizing piston rod portion to be eliminated so that the space lengthwise taken up by the ram assembly may be reduced.

2 Claims, 1 Drawing Sheet

Fig. 1.
PRIOR ART
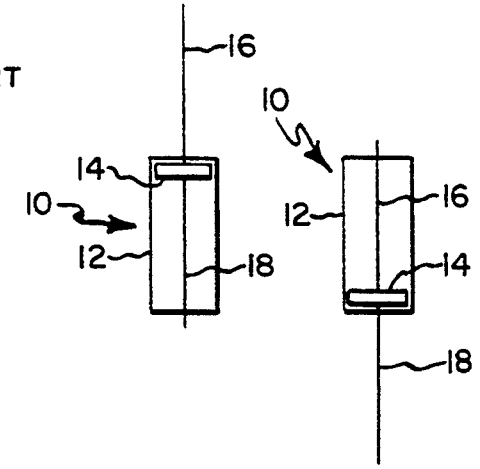
Fig. 2.
PRIOR ART
Fig. 4.
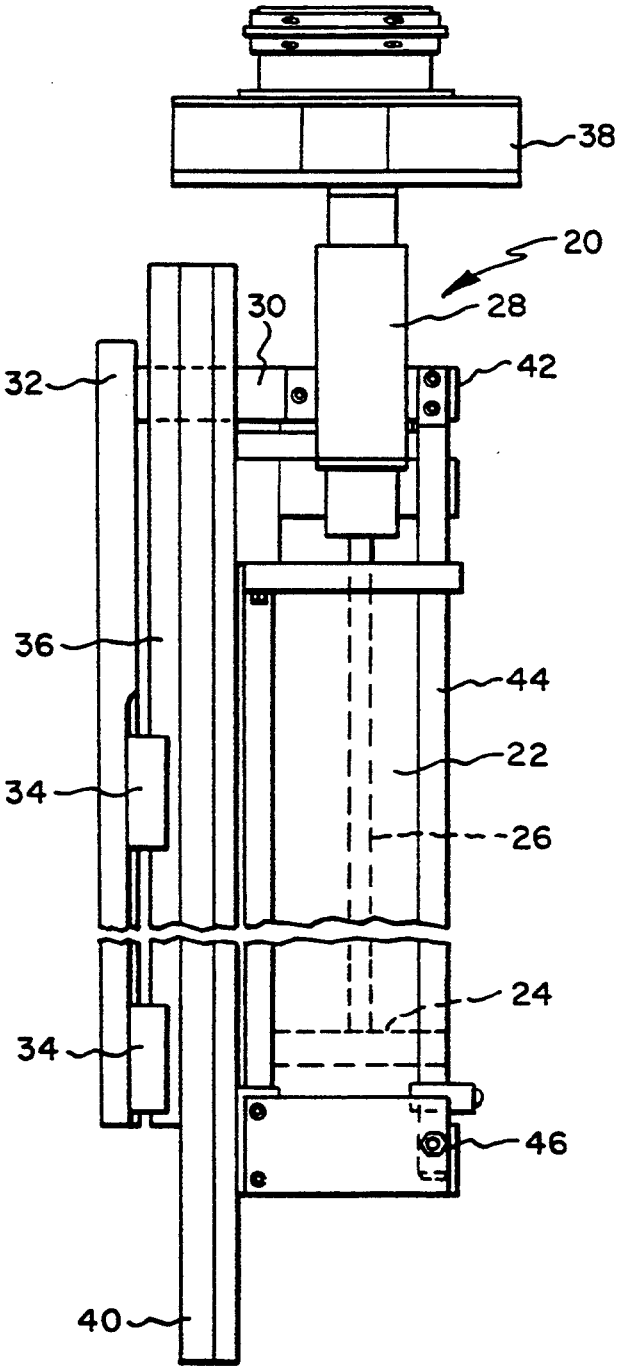
Fig. 3.
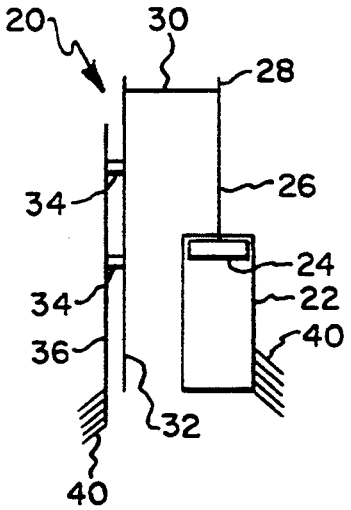

PISTON ROD STABILIZING DEVICE FOR A RIVETING APPARATUS RAM ASSEMBLY

The present invention relates generally to riveting apparatus. More particularly, the present invention relates to a ram assembly for applying force to upset a rivet.

Examples of riveting apparatus include U.S. Pat. No. 4,662,556 to Gidlund; 4,854,491 to Stoewer; and 4,908,928 to Mazurik et al.

U.S. Pat. No. 4,908,928 to Mazurik et al, which is assigned to the assignee of the present invention and which is incorporated herein by reference, discloses a riveting apparatus which includes a pair of rams for applying a rivet upsetting force to opposite ends of a rivet, which is designated R therein. One of the ram means is designated 58 therein. This ram means is carried by one end of a clamp piston, designated 32, which is in turn interconnected with a ram piston, designated 60 therein, by a piston rod, designated 62. This piston is disposed within a double-acting ram cylinder. In order to provide for stability, the cylinder is disclosed as being double-ended, i.e., in addition to the piston rod extending out the upper end of the cylinder, a stabilizing lower portion, designated 66 therein, of the piston rod extends out the lower end of the cylinder. This stability is required in order to achieve a very close tolerance of perhaps 0.005 inch at the work point, i.e., at the point of contact with the rivet for upset thereof.

While such a stabilizing means is generally satisfactory, there are instances where the additional overall space length-wise required of the ram assembly because of the lower piston rod portion undesirably interferes with the positioning of the riveting apparatus. Thus, for example, a lift platform may undesirably be required.

Mazurik et al also discloses that alternate stabilizing methods include dual pistons, where two pistons are used within the same cylinder housing, and external guides which support the cylinder rod in its extended position. Riveting machines have been provided wherein an external guide has comprised an external housing in end-to-end relation with the cylinder and receiving a rod which is attached to the piston and extends out the cylinder for guiding reciprocating movement therein during reciprocating movement of the cylinder rod.

Like the stablizing lower piston rod portion previously described, the provision of the housing to act as an external guide for the rod also results in a longer effective cylinder length which may undesirably interfere with the positioning of the riveting apparatus.

It is accordingly an object of the present invention to provide a riveting apparatus ram assembly which takes up minimal overall space length-wise yet is suitably stabilized. Thus, it is an object of the present invention to eliminate the need for a lower stabilizing piston rod portion or other guides adding to the effective cylinder length in such a ram assembly.

It is a further object of the present invention to provide such a ram assembly which does not suffer from the disadvantages of the prior art.

It is still another object of the present invention to provide such a ram assembly which is rugged and reliable yet can be manufactured at a reduced cost.

In order to provide such a ram assembly, in accordance with the present invention the piston rod is connected to an elongate member which is supported for movement therewith by linear bearing means. The linear bearing means is provided to orient the movement of the elongate member to in turn control the orientation of the piston rod as riveting force is applied.

The above and other objects, features, and advantages of present invention will be apparent in the following detailed description of the preferred embodiment thereof wherein the same reference numeral denotes the same or similar parts throughout the several views.

BRIEF DESCRIPTION OF THE DRAWINGS

FIG. 1 is a schematic view of a ram assembly which includes a stabilizing means in accordance with the prior art with the piston at the end of a riveting stroke.

FIG. 2 is a schematic view of the assembly of FIG. 1 with the piston at the end of the return stroke.

FIG. 3 is a schematic view of a riveting apparatus ram assembly which embodies the present invention.

FIG. 4 is a side elevation view of a riveting apparatus ram assembly in accordance with the present invention.

DETAILED DESCRIPTION OF THE PREFERRED EMBODIMENTS

Referring to FIGS. 1 and 2, there is illustrated at 10 a ram assembly of the prior art for riveting apparatus. The ram assembly 10 includes a cylinder 12 having a piston 14 and a piston rod portion 16 extending from one side of the piston (upwardly in FIG. 1) and through one end of the cylinder for applying rivet upset force. FIG. 1 shows the position of the piston 14 at the end of the riveting stroke. FIG. 2 shows its position after it has been retracted. In order to stabilize the rivet upset stroke, another piston rod portion 18 extends from the other side of the piston 14 (downwardly in FIGS. 1 and 2) and through the other or lower end of the cylinder 12. Such an arrangement is shown in greater detail in Mazurik et al and discussed in the first full paragraph in Col. 3 thereof.

While such an arrangement is generally satisfactory, FIGS. 1 and 2 show the additional overall space lengthwise required because of the lower piston rod portion 18 with the result that the riveting will necessarily take place at an undesirable height and a lift platform may be required. The provision of dual pistons or an external guide in the form of a rod housing in end-to-end relation with the cylinder also requires additional overall space lengthwise. In any event, the ram assembly may not be as compact as desired.

Referring to FIGS. 3 and 4, there is illustrated generally at 20 a ram assembly which allows the lower stabilizing piston rod portion of FIGS. 1 and 2 to be eliminated so that the assembly 20 may be more compact lengthwise yet allows stabilization of the piston rod to be maintained. Ram assembly 20 includes a cylinder 22 in which is contained a ram piston 24. An elongate piston rod 26 for providing rivet upset force is connected to one side (the upper side in FIGS. 3 and 4) of the piston 24. Contrary to the prior art of FIGS. 1 and 2, no piston rod portion extends downwardly from the lower side of the piston 24. The upper end 28 of the piston rod 26 is connected to a suitable turntable mechanism, illustrated at 38, which carries an anvil (not shown) for contacting a rivet for applying upset force thereto as well as providing tooling support for fastening, drilling, and the like. A limit switch 46 is actuated by elongate actuator member 44, which is suitably connected to piston rod 26 by means of collar 42 for movement with the piston rod 26 and parallel thereto, in accordance with principles commonly known to those of ordinary skill in the art to which this invention pertains, to indicate the bottom of the piston stroke so that another riveting operation can be initiated. As illustrated in Mazurik et al, a pair of ram assemblies may be provided on opposite sides of a workpiece for engaging opposite ends of a rivet for applying upsetting force thereto. Except for the ram assembly 20 as disclosed herein, the riveting apparatus may be as shown and described in Mazurik et al. The turntable 38 is of a conventional type commonly known in the art to which this invention pertains and is therefore not described in greater detail herein.

Riveting apparatus requires that translation of the piston rod 26 be precisely controlled within a tolerance of perhaps about 0.005 inch so as to precisely position the anvil end 28 for applying upset force. In order to compactly provide such piston rod stabilization, the upper or anvil end 28 of the piston rod 26 is suitably rigidly connected by means of a connector member 30 and collar 42 to an elongate member 32 which is parallel to piston rod 26 and extends alongside the exterior of the cylinder 22. Movement of the piston rod 26 thus effects movement of this track mounting plate 32. The cylinder 22 is rigidly connected to a mounting plate 40. Member 32 is attached to a pair of longitudinally spaced linear bearings 34 which are mounted for movement along the length of an elongate rail or stabilizer bar 36, which is rigidly connected to mounting plate 40. Stabilizer bar 36 is suitably oriented parallel to a predetermined orientation of the piston rod 26 during its movement. Thus, as the piston 24 is moved upwardly in FIGS. 3 and 4, member 32 is simultaneously moved upwardly, but the linear bearings 34 mounted to the stabilizer member 36 are provided to control the tolerance or lateral deviation of the member 32 during such upward movement to thereby control the orientation of the piston rod 26 as riveting force is applied by the anvil end 28 thereof.

Thus, the stabilizer bar 36 is provided to control the lateral deviation of the piston rod 26 during its movement longitudinally to maintain a close tolerance of perhaps about 0.005 inch at the work point during application of rivet upset force yet without the requirement of a lower stabilizing piston rod portion which would increase the space length-wise taken up by the ram assembly.

It should be understood that while the invention has been described in detail herein, the invention can be embodied otherwise without departing from the principles thereof, and such other embodiments are meant to come within the scope of the present invention as defined in the appended claims.

What is claimed is:

1. A riveting apparatus ram assembly comprising a cylinder, a piston within said cylinder, means including a piston rod attached to said piston for applying a riveting force, and means for stabilizing the travel of said piston rod for application of said riveting force, said piston rod stabilizing means comprising an elongate member, linear bearing means for orienting movement of said elongate member, and means for rigidly connecting said elongate member to said piston rod for movement with said piston rod, said linear bearing means comprising an elongate mounting plate which is mounted alongside said cylinder and a pair of linear bearings which are mounted to said mounting plate for movement along the length thereof and which are attached to said elongate member to control the orientation of said elongate member to in turn control the orientation of said piston rod as riveting force is applied, said elongate member and said linear bearing means extending alongside said cylinder.

2. A ram assembly according to claim 1 wherein said piston rod includes a piston end to which said piston is attached and an anvil end, said connecting means comprising a member which is connected to said elongate member and is connected to said piston rod at a position along said piston rod which is adjacent said anvil end and spaced from said piston.

* * * * *